United States Patent [19]

Nellen et al.

[11] 3,993,086

[45] Nov. 23, 1976

[54] DEVICE FOR COOLING BAND COILS IN HOT ROLLING STRIP MILLS

[75] Inventors: Wilhelm Nellen, Holzen; Wolfgang Fabian; Theodor Sevenich, both of Dortmund, all of Germany

[73] Assignee: Hoesch Werke Aktiengesellschaft, Dortmund, Germany

[22] Filed: Nov. 25, 1974

[21] Appl. No.: 527,066

Related U.S. Application Data

[63] Continuation of Ser. No. 332,430, Feb. 14, 1973, abandoned.

[30] Foreign Application Priority Data

Feb. 15, 1972 Germany ..... 2207026

[52] U.S. Cl. ..... 134/57 R; 134/14; 134/67; 134/133; 266/88; 266/131

[51] Int. Cl.[2] ..... B08B 3/04

[58] Field of Search ..... 134/14, 57 R, 67, 133; 266/4 A, 6 R

[56] References Cited

UNITED STATES PATENTS

| | | | |
|---|---|---|---|
| 618,396 | 1/1899 | Cowles | 134/14 X |
| 923,356 | 6/1909 | Hore | 266/6 R |
| 2,596,493 | 5/1952 | Linney | 134/57 R |
| 3,378,412 | 4/1968 | Mansfield et al. | 266/6 R X |

FOREIGN PATENTS OR APPLICATIONS

| | | | |
|---|---|---|---|
| 718,109 | 11/1954 | United Kingdom | 134/14 |

*Primary Examiner*—Robert L. Bleutge
*Attorney, Agent, or Firm*—Walter Becker

[57] ABSTRACT

An arrangement for cooling hot rolled steel bands reeled into coils, according to which the rolling hot steel band after having been rolled into coils are cooled in a liquid bath.

1 Claim, 4 Drawing Figures

DEVICE FOR COOLING BAND COILS IN HOT ROLLING STRIP MILLS

This is a continuation of application Ser. No. 332,430 —Nellen filed Feb. 14, 1973 now abandoned.

The present invention relates to cooling hot rolled steel bands, especially hot wide bands, reeled into coils, and also concerns an arrangement for practicing this in a hot strip rolling mill, especially wide strip rolling mill, according to which as continuation of a manufacturing line there are provided a reeling system as well as a transporting line for transporting the band coils to a storage place.

Heretofore the transport of the coils from the underfloor reels to the coil storage place of a wide band rolling mill was primarily effected by stepwise operating conveyors designed as chain conveyors or walking beam conveyors, while the conveying paths simultaneously served as cooling paths. The conveying paths, therefore, had to be designed as to their length so that, based on the maximum output of the rolling train, the coils could be transported with their axes in vertical direction for a period of from 1 ½ to 2 hours without becoming out of round. Consequently, the transport chains must be relatively long up to the storage place for the coils. At the storage place difficulties are encountered with regard to the transfer of the coils. With small coils and short coil sequence inherent thereto, the coils can at the storage place not be taken off at one point from the conveyor in this short sequence in which they arrive because the transport cranes impede each other. Therefore, it is customary that a transport chain is in longitudinal direction thereof passed through the coil storage place so that the coils can be taken off from the conveyor simultaneously at a plurality of stations and the cranes do not have to move over long distances. In view of described difficulties, the coil transporting systems require considerable space and are expensive; in many instances it is necessary to arrange the coil storage places at a considerable distance from the rolling train and to move the coils by conveyors over very long open areas in order to obtain the necessary length of the conveyor distances. If under such circumstances tracks or streets have to be crossed, the coil conveyors have to be arranged below the ground or above bridges, whereby the costs are still further increased. In the coil storage place itself, large areas have to be provided for cooling the coils. With the nowadays customary outer diameters of the coils of 2000 mm, the cooling period of the coils amounts to approximately from 4 to 5 days, and with the most modern wide strip rolling trains with a coil diameter of 2600 mm, cooling periods of from 7 to 8 days have to be considered.

Wide strip rolling trains of this type will alone for the cooling of the coils in the coil storage place need a space of from 15,000 to 20,000 $m^2$.

In order to cope with these difficulties, it has been suggested with some wide strip rolling trains to sprinkle the coils on the transport chains with water. The cooling effect obtained in this way is, however, rather minor, and it is very difficult to assure a uniform cooling of the coils. Moreover, the transporting devices are subjected to a considerable wear due to oxidation because they come into contact not only with the water but also with the air.

It is, therefore, an object of the present invention to overcome the above mentioned drawbacks and to develop an arrangement for carrying out this by means of which it will be possible in a simple manner to cool the band coils coming from the reeling station of a hot strip rolling mill within a very small space while maintaining certain desired physical properties of the steel bands.

These and other objects and advantages of the invention will appear more clearly from the following specification in connection with the accompanying drawings, in which:

FIG. 1 diagrammatically illustrates a vertical longitudinal section through a cooling liquid containing vat provided in the transporting line.

Figure 1:
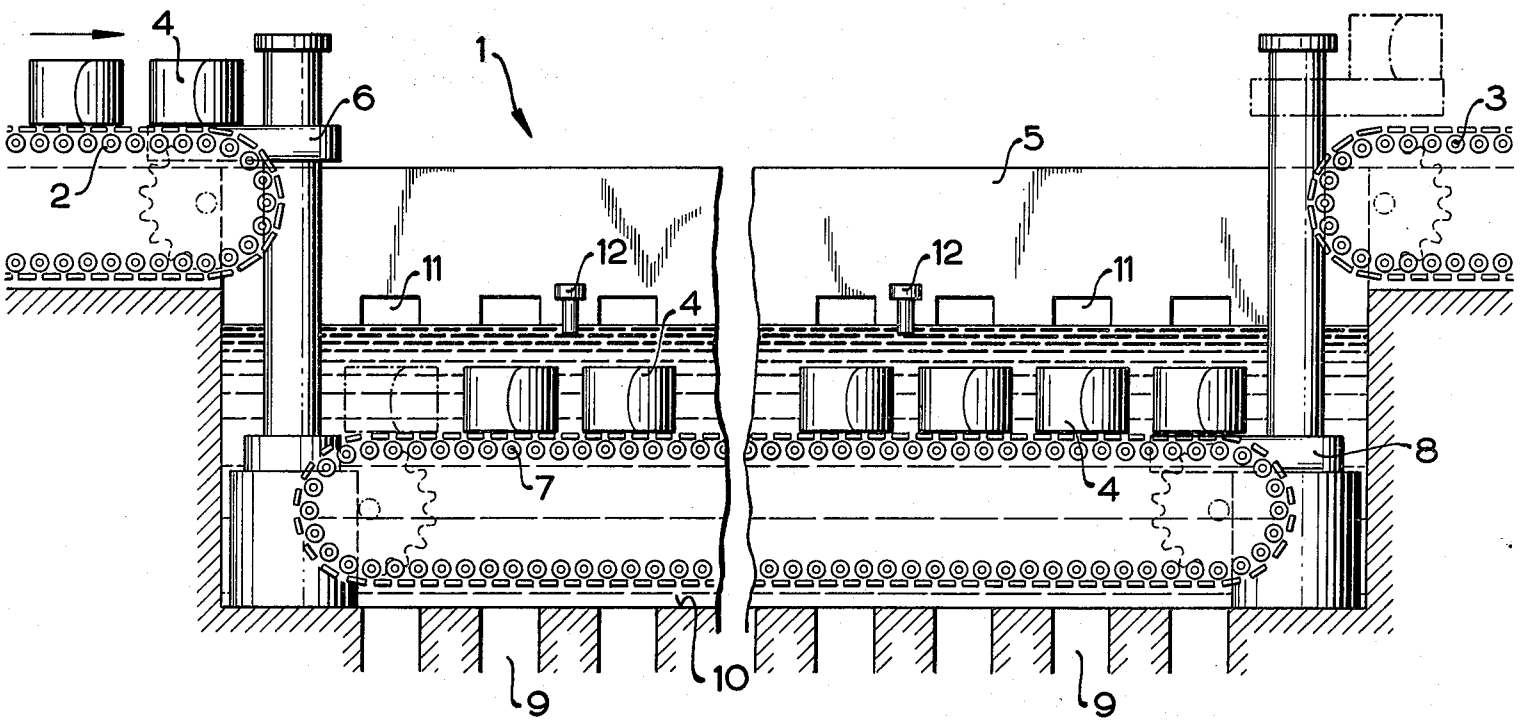

The objects set forth above have been realized according to the present invention by cooling the rolling-hot steel bands reeled into coils in a liquid bath following the reeling up operation. Expediently, the rolling-hot band coils are for purposes of obtaining certain physical properties, such as increased strength or toughness, cooled in a first stage by air and in a second stage in a cooling liquid bath. Furthermore, it is expedient to cool the rolling-hot band coils in a first stage in a liquid bath and subsequently to cool the band coils in air for hardening the material. According to a particularly advantageous manner, the flow of the cooling liquid in the cooling bath is by the specific arrangement of the inlet and outlet openings, the temperature feelers and a computer coupled thereto so directed and controlled that, depending on the respective requirements of different materials, the crystalline transformation will not be disturbed or prevented at the stopping points.

The device for practicing the invention in a hot strip rolling mill, especially in a wide strip rolling mill, in which the rolling train is followed by a reeling system and a transporting line for transporting the band coils to the coil storage place, is so designed that in the transporting line for moving away the coils there is interposed a cooling liquid vat with transporting and transferring devices.

A practical embodiment of such a device consists in that the transporting devices for the band coils coming from the reeling station and the cooling liquid vat are arranged in line one behind the other. A further practical embodiment may be so designed that the cooling liquid vat with the transporting devices, the lifting devices and the feeding and withdrawing devices is arranged in parallel and adjacent to the transporting line for the rolling-hot band coils coming from the reeling station. Advantageously, in the cooling liquid vat there are arranged a plurality of transporting devices which are parallel to each other in their longitudinal direction. Furthermore, the bottom of the cooling liquid vat may be provided with inlet openings, and above the band coils in the cooling liquid vat there are provided in the longitudinal sides of the vat, discharge openings. Furthermore it is possible to arrange the inlet openings on one longitudinal side of the vat below the coils and to arrange the outlet openings at the oppositely located side above the coils in the vat. The cooling liquid vat is advantageously furthermore provided with inlet openings at the outlet side of the coils below the coils and with outlet openings at the inlet side of the coils above the coils in the cooling liquid vat.

The advantages of the arrangement according to the invention are seen in particular in the fact that without high costs, for instance for underpasses and overpasses of the coil conveyors under and over tracks, and with little space it is possible to cool the band coils coming from the reeling station of a hot strip rolling mill in a minimum of time and uniformly while maintaining the desired physical properties of the materials.

Figure 3:
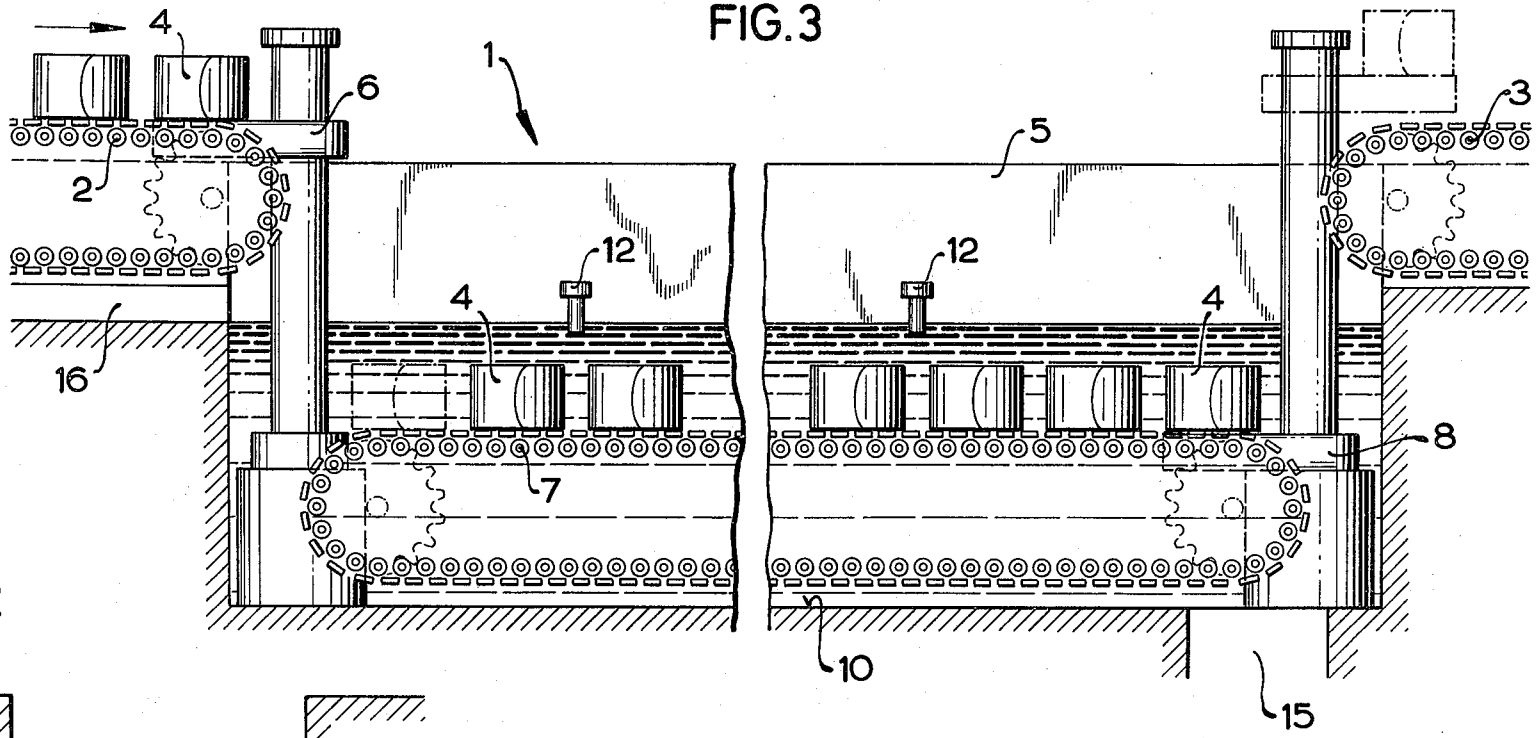
FIG. 3 illustrates a further embodiment of the cooling vat provided in conformity with the invention in the transporting line, the vat being shown in a vertical longitudinal section.
Figure 2:
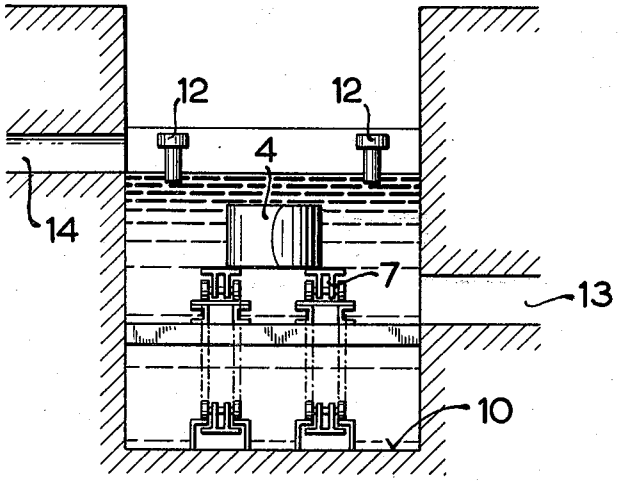
FIG. 2 is a vertical cross section through the cooling vat of FIG. 1.

Referring now to the drawings in detail, according to FIGS. 1–3, a cooling liquid vat 5 is interposed in the transporting line 1 of a hot strip rolling mill including the transporting devices 2, 3, for instance chain conveyors, for withdrawing the band coils 4 from a non-illustrated reeling station. The vat 5 is equipped with transferring and transporting devices 6, 7, 8 for handling the coils 4. The bottom 10 of the vat 5 has inlet openings 9 for admitting the cooling liquid and has outlet openings 11 at the longitudinal sides thereof. Furthermore, temperature feelers 12 are installed in the vat 5. The band coils 4 are by means of the transporting device 2 moved to the vat 5 where they are received by the transferring device 6 and are deposited onto the transporting device 7 provided in the vat 5. At the oppositely located end face of the vat 5, the band coils 4 are by means of the transferring device 8 taken off from the transporting device 7 in the vat 5 and are transferred to the transporting device 3 provided in the transporting line 1. The transporting device 3 conveys the band coil 4 to a non-illustrated storage place for the coils.

The speed of cooling the coils 4 is in the illustrated arrangement realized by controlling the temperature of the cooling liquid which temperature is continuously ascertained by the temperature feelers 12, and is furthermore realized by controlling the admitted quantity of cooling liquid. The cooling liquid enters the vat 5 through the inlet openings 9 in the bottom 10 of the vat 5 and is discharged through the discharge or outlet openings 11 in both longitudinal sides of vat 5, or, as shown in FIG. 2, enters vat 5 through the openings 13 in one longitudinal side of vat 5 below the coils 4 and is discharged through openings 14 above the coils 4 so that a diagonal flow of the cooling liquid transverse to the transporting direction of the coils 4 is created.

As illustrated in FIG. 3, the cooling liquid may also be admitted into vat 5 at the outlet side through the opening 15 in the bottom 10 of the vat 5 and may then pass through the vat 5 in a direction counter to the direction of transportation of the coils 4 and in longitudinal direction, and may leave vat 5 through the openings 16 at the inlet side of vat 5. The openings 15, 16 may also be located, in contrast to the illustration, on the side walls of the vat 5 so that the flow of the cooling liquid is effected diagonally in the longitudinal direction of vat 5.

The temperature in the cooling liquid vat 5 is controlled by varying the quantity of the admitted cooling liquid and thus by a change in the flow velocity. For controlling the temperature of the cooling liquid and its adaptation to the various materials, the temperature of the cooling liquid is continuously measured by the temperature feelers 12 built into the vat 5. The measured values are advantageously conveyed to a non-illustrated processing computer which compares the measured values with the rated values introduced into the computer and automatically by influencing the velocity of the cooling liquid corrects the temperature of the cooling liquid in vat 5. With steels of high strength which must not be cooled in a cooling liquid, it is possible by discharging the cooling liquid, to cool the coils 4 by means of air as is generally customary.

Figure 4:
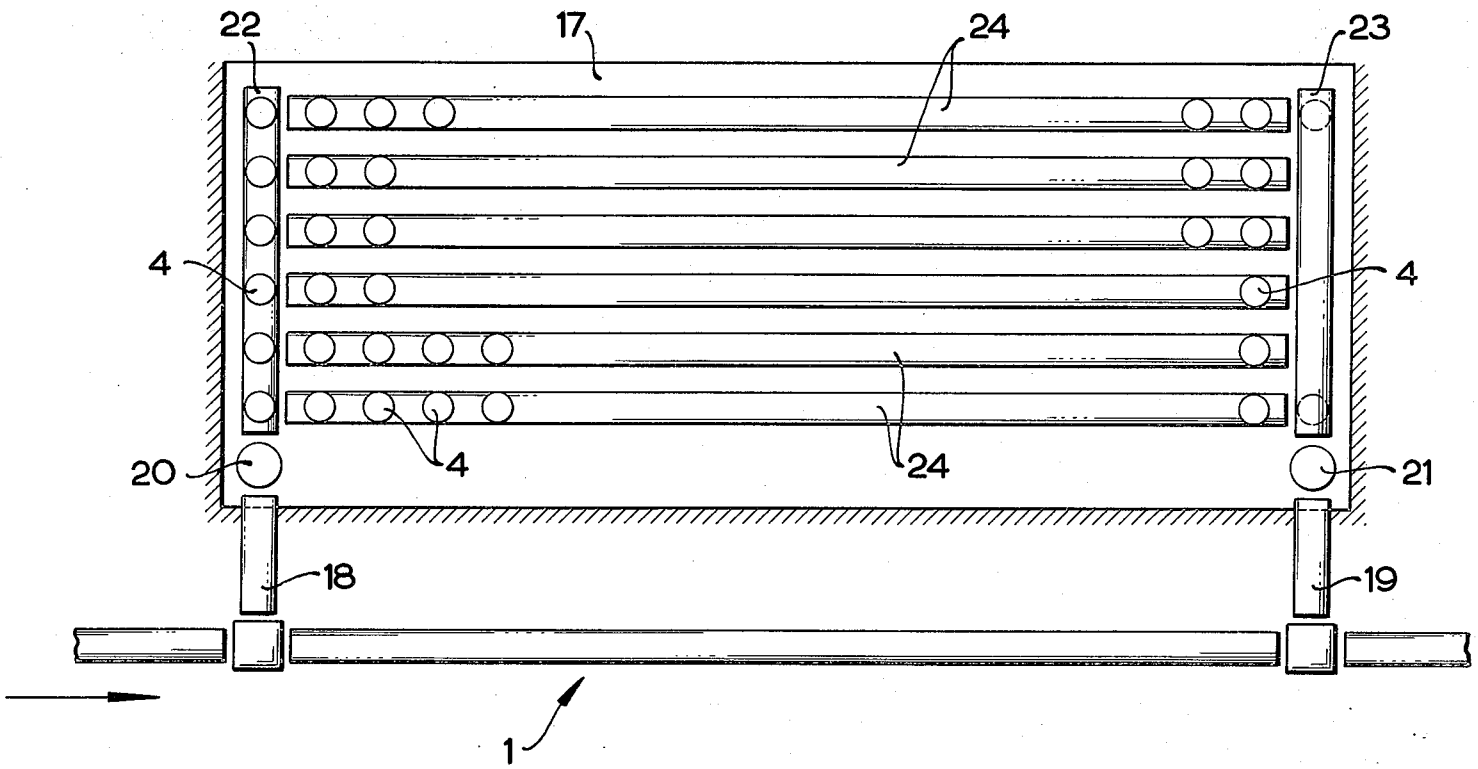
FIG. 4 is a top view of a cooling vat arranged parallel and adjacent to the transporting line.

A further embodiment of the invention is illustrated in FIG. 4 according to which a cooling liquid vat 17 is arranged parallel and adjacent to the transporting line 1. Vat 17 is provided with a feeding and withdrawing device 18, 19 and a lifting device 20, 21 each at the ends of that longitudinal side of vat 17 which faces the transporting line 1. Moreover, at the end faces of vat 17 there are respectively arranged a transverse transporting device 22, 23 parallel to the end faces and a plurality of longitudinal transporting devices 24 which extend parallel to each other in the longitudinal direction of the vat between the transporting devices 22, 23.

The coils 4 are by means of a conveying device 18 withdrawn from the transporting line 1 and transferred to the lifting device 20 located in the cooling liquid vat 17. In the vat 17, the coils 4 are transferred from the lifting device 20 to the transporting device 22 which is parallel to the end face of the vat 17. The transporting device 22, which in conventional manner is designed as chain or walking beam conveyor, transports the coils 4 stepwise in transverse direction with regard to vat 17. When all stopping points of the transporting device 22 are filled by a coil 4, the coils 4 are simultaneously transferred to the conveying devices 24 operating in the longitudinal direction of vat 17. The transporting device 22 will in this way in one single conveying step be emptied so as to be able to be loaded with new coils 4. During the same step during which the transporting devices 24 lift the coils 4 from the transporting device 22, they transfer at the other end face of vat 17 the same number of coils 4 to the transporting device 23 which is parallel to the last mentioned end face and is located in vat 17. By means of the transporting device 23 the coils 4 are stepwise conveyed in the direction toward the lifting device 21 and transferred thereto. The coils 4 are by the lifting device 21 lifted out of vat 17 and deposited on the transporting device 19 which returns the coils 4 to the transporting line 1.

The supply of cooling liquid to the vat 17 is, in conformity with FIG. 4, effected in the same manner as is the case with the cooling liquid vats of one of the arrangements of FIGS. 1–3. The temperature of the cooling liquid may also be controlled in the same manner by temperature feelers and with the aid of a computer.

Depending on the respective requirements of the material to be cooled, arrangements according to FIGS. 1–3 and/or arrangements according to FIG. 4 may be provided in series or in parallel arrangement.

With regard to the cooling of the coils, it may be mentioned by way of example that it has been found highly satisfactory to cool the coils in water to a maximum of 80° C. whereupon they may be pickled immediately. If the coils are not to be pickled immediately but are to be stored for some time, or in order to realize certain technological or physical properties, any desired temperature drop may be selected and set between the reeling temperature and the water inlet temperature. The water inlet temperature into the vat 5 should preferably be between 12° and 28° C., whereas the water outlet temperature, i.e. the temperature of the water leaving the vat is within the range of from 30° to 80° C.

The temperature of the coils at which the coils are reeled amounts from 550° to 700° C., depending on the quality or grade of the steel. From this temperature the coils are at their outer windings cooled by about from 100° to 150° C. The temperature of the air which is drawn in for cooling purposes is about room temperature. The air temperature after the air has been used for cooling the coils does usually not exceed 600° C.

It is, of course to be understood that the present invention is, by no means, limited to the specific showing in the drawings, but also comprises any modifications within the scope of the appended claims.

What we claim is:

1. An arrangement for cooling hot rolled steel bands reeled into coils, especially hot rolled wide strips, which includes: a vat adapted to receive and contain a cooling liquid bath, feeding conveyor means operable to receive hot rolled steel bands reeled into coils about a central axis and to feed the same with the axis of each coil in substantially vertical position to said vat at one end, first transferring means at said one end of said vat, including a lifting device operable to lower the coils with the axis of each coil in vertical position from said feeding conveyor means into said vat, a plurality of longitudinal transporting means arranged within said vat for receiving the coils from said first transfer means and transporting the same with the axis of each coil in vertical position through said vat, withdrawing conveyor means for conveying cooled coils away from said vat at the opposite end, second transferring means at said opposite end of said vat including a lifting device operable to lift the coils with the axis of each coil in vertical position for transferring uniformly cooled coils from said transporting means onto said withdrawing conveyor means, said vat being provided with fluid inlet means for admitting cooling liquid into said vat and also being provided with fluid outlet means for discharging heated-up cooling liquid from said vat, and control means associated with said vat and including temperature sensing means operable automatically to ascertain the temperature of the cooling liquid and to control the speed of flow thereof through said vat to thereby control the temperature of said cooling liquid.

* * * * *